US006071090A

United States Patent [19]

Miki et al.

[11] Patent Number: 6,071,090

[45] Date of Patent: Jun. 6, 2000

[54] PROCESS PUMP

[75] Inventors: Hiroyuki Miki; Tsuyoshi Kagami; Yoshihiro Shono, all of Yawara, Japan

[73] Assignee: SMC Corporation, Japan

[21] Appl. No.: 08/909,609

[22] Filed: Aug. 12, 1997

[30] Foreign Application Priority Data

Aug. 12, 1996 [JP] Japan ..... 8-227337

[51] Int. Cl.[7] ..... F04B 43/06

[52] U.S. Cl. ..... 417/395; 417/454; 92/100

[58] Field of Search ..... 417/395, 454; 92/100, 99

[56] References Cited

U.S. PATENT DOCUMENTS

| | | | |
|---|---|---|---|
| 5,378,122 | 1/1995 | Duncan | 417/395 |
| 5,743,169 | 4/1998 | Yamada | 92/100 |

FOREIGN PATENT DOCUMENTS

| | | | |
|---|---|---|---|
| 6-29503 | 1/1989 | Japan | 417/395 |
| 3-67075 | 3/1991 | Japan | 417/395 |
| 746847 | 3/1956 | United Kingdom | 417/395 |

*Primary Examiner*—Timothy S. Thorpe
*Assistant Examiner*—Cheryl J. Tyler
*Attorney, Agent, or Firm*—Baker & Botts, L.L.P.

[57] ABSTRACT

A diaphragm-type double-acting process pump has a reduced number of members to be assembled to a center plate and also a reduced number of hermetically sealed portions. A space defined by the center plate, together with a side cover and a side body, which are provided on both sides, respectively, of the center plate, is divided by two diaphragms into left and right driving chambers inside the diaphragms and left and right pump chambers outside the diaphragms. The left and right pump chambers are communicated with a suction opening through check valves and also communicated with a discharge opening through check valves. The center plate is fitted in a recess formed in the side body, and the side cover is brought into contact with both the side body and the center plate to clamp the center plate by the side cover and the side body. Passages for communication between the suction opening and the left and right pump chambers and passages for communication between the discharge opening and the pump chambers are provided in the side body and the side cover. A controller is provided in the center plate.

7 Claims, 9 Drawing Sheets

PROCESS PUMP

BACKGROUND OF THE INVENTION

The present invention relates to an air-driven diaphragm-type process pump for transferring various fluids, e.g. chemicals, paints, and beverages.

In a conventional diaphragm-type double-acting process pump, diaphragms are connected together by being clamped to both the left and right sides of a center plate (body) by pump bodies, and a suction-side plate and a discharge-side plate are connected to the upper and lower ends, respectively, of the connected diaphragm assembly. Spaces formed between the center plate and the diaphragms on both sides thereof are defined as driving chambers, and spaces formed between the diaphragms and the pump bodies are defined as pump chambers. Inlet- and discharge-side check valves are provided in the upper and lower end portions of the pump bodies. A suction opening and the pump chambers are communicated through the inlet-side check valves, and a discharge opening and the pump chambers are communicated through the discharge-side check valves (for example, see Japanese Utility Model Application Post-Examination Publication No. 6-29503).

In the conventional process pump, the constituent members are assembled together from four directions, i.e. from the left, right, upper and lower sides of the center plate. Therefore, it is necessary to effect positioning (alignment) during the assembly operation, and hermetic sealing is required at the four joints of the assembly. To inspect or replace the check valves, it is necessary to detach the suction-side plate and the discharge-side plate from the upper and lower ends of the connected diaphragm assembly. To inspect or replace the diaphragms, it is necessary to detach not only the suction- and discharge-side plates but also the pump bodies, which are provided on the left and right sides of the center plate.

SUMMARY OF THE INVENTION

A first object of the present invention is to reduce the number of members to be assembled to a center plate and also the number of hermetically sealed portions in a diaphragm-type double-acting process pump.

A second object of the present invention is to facilitate the replacement of check valves and diaphragms in a diaphragm-type double-acting process pump.

To attain the above-described objects, the present invention provides a process pump of the type wherein a space defined by a center plater together with a side cover and a side body, which are provided on both sides, respectively, of the center plate, is divided by two diaphragms into left and right driving chambers inside the diaphragms and left and right pump chambers outside the diaphragms. The two diaphragms are connected together by a connecting member extending through an insertion hole in the center plate. The left and right driving chambers are alternately supplied with and exhausted of air under control of a controller. The left and right pump chambers are communicated with a suction opening through check valves and also communicated with a discharge opening through check valves. According to a first aspect of the present invention, the center plate is fitted in a recess formed in the side body, and the side cover is brought into contact with both the side body and the center plate to clamp the center plate by the side cover and the side body. Passages for communication between the suction opening and the left and right pump chambers and passages for communication between the discharge opening and the left and right pump chambers are provided in the side body and the side cover. The controller is provided in the center plate.

According to a second aspect of the present invention, the outer peripheral portion of one of the two diaphragms is clamped between a stepped clamp portion of the recess in the side body and one of two clamp portions of the center plate, and the outer peripheral portion of the other diaphragm is clamped between an abutting portion of the side cover and the other clamp portion of the center plate.

According to a third aspect of the present invention, the side body and the side cover have stepped insertion holes opening on the upper and lower surfaces thereof. The check valves are inserted into the stepped insertion holes, respectively. Each stepped insertion hole is closed with a check valve cover. The suction opening is communicated with the pump chambers through a pair of check valves, and the discharge opening is communicated with the pump chambers through the other pair of check valves.

According to a fourth aspect of the present invention, the suction opening and the discharge opening open on the right side surface of the side body. The check valves are provided in the right end portions of the side body and the side cover. The suction opening is communicated with the inlet sides of a pair of check valves, and the discharge opening is communicated with the outlet sides of the other pair of check valves.

According to a fifth aspect of the present invention, the check valves each comprise an approximately cylindrical valve seat member and a check valve element. Each suction-side valve seat member has a communicating groove formed in a side portion thereof below a valve seat formed by the valve seat member. Each discharge-side valve seat member has a communicating groove formed in a side portion thereof above a valve seat formed by the valve seat member. Each suction-side communicating groove is communicated with the suction opening through a suction-side communicating passage, and each discharge-side communicating groove is communicated with the discharge opening through a discharge-side communicating passage.

According to a sixth aspect of the present invention, a switching valve of the controller is provided in the center plate. The switching valve is arranged such that resilient force from a spring and an air pressure constantly act on one end of a spool of the switching valve, and a pilot air pressure acts on the other end of the spool.

According to a seventh aspect of the present invention, an air supply opening and an air exhaust opening are provided to open on the left side surface of the center plate. The switching valve is inserted into a switching valve insertion hole having an opening on the left side surface of the center plate. The other end of the spool is disposed closer to the opening of the switching valve insertion hole. The opening of the insertion hole is hermetically closed with a manual cap. A manual pin for controlling the spool is provided in the manual cap.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIGS. 2(*a*) to 2(*d*) show the external shape of the double-acting process pump according to the embodiment of the present invention, in which: FIG. 2(*a*) is a side view of the process pump as viewed from the left-hand side thereof; FIG. 2(*b*) is a front view of the process pump; FIG. 2(*c*) is a side view of the process pump as viewed from the right-hand side thereof; and FIG. 2(*d*) is a top plan view of the process pump.

FIG. 3(*b*) is a sectional view taken along the line G—G in FIG. 3(*a*).

FIG. 5(*b*) is an enlarged view showing an essential part of the arrangement shown in FIG. 5(*a*).

DESCRIPTION OF THE PREFERRED EMBODIMENTS

The present invention will be described below in detail with reference to the accompanying drawings.

FIGS. 1 to 9 show an embodiment of a double-acting process pump according to the present invention.

Figure 1:
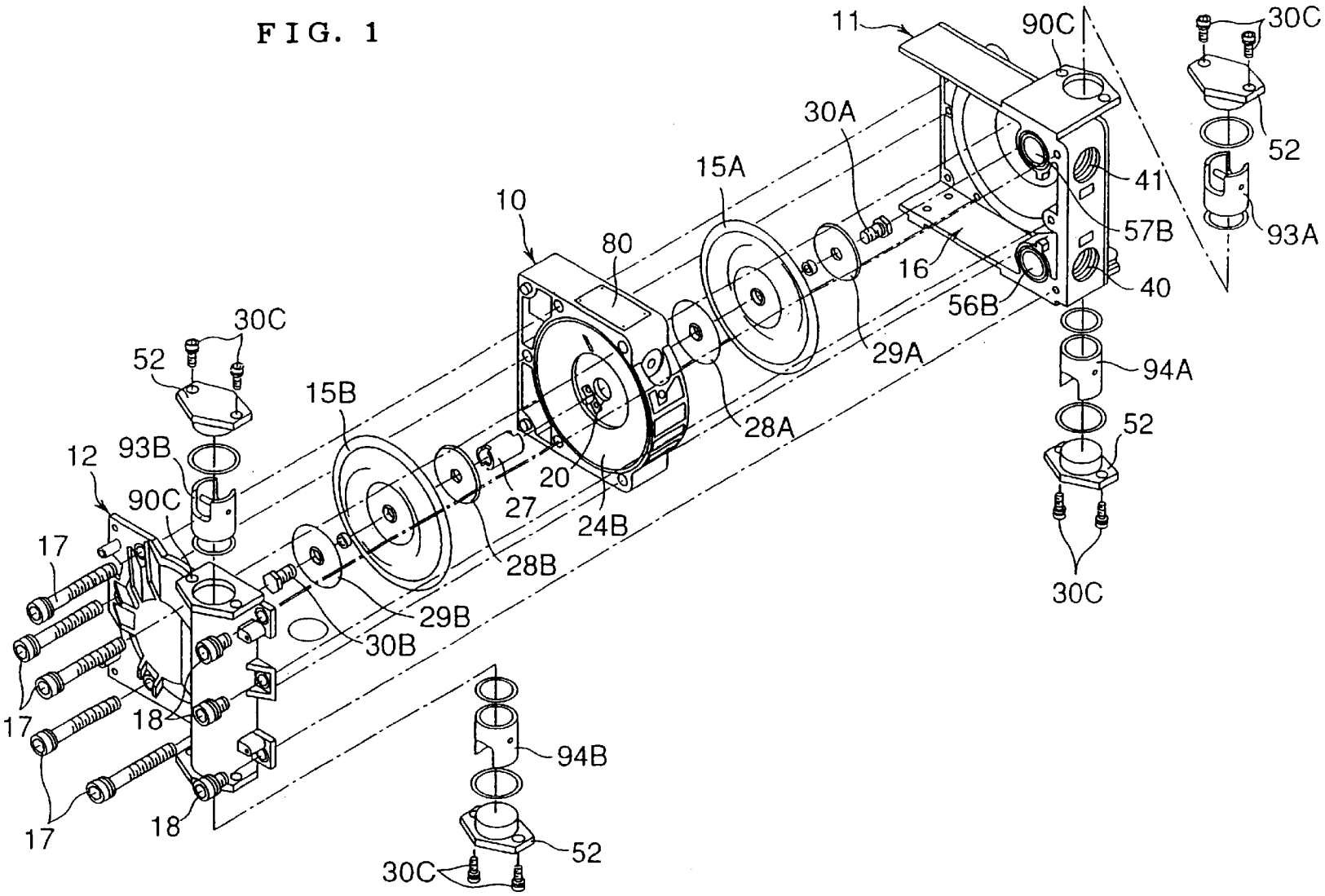
FIG. 1 is an exploded perspective view of a double-acting process pump according to an embodiment of the present invention, showing the essential parts thereof with resin covers removed therefrom.
Figure 2D:
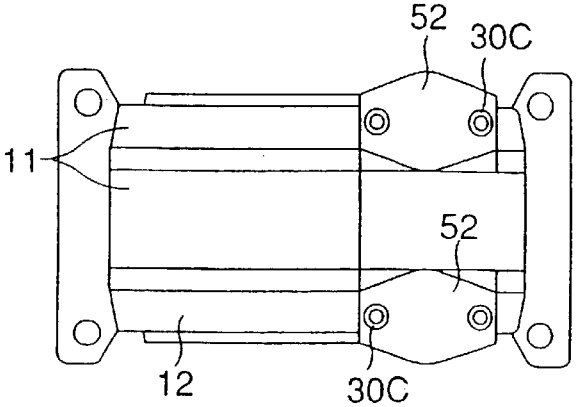
Figure 2B:
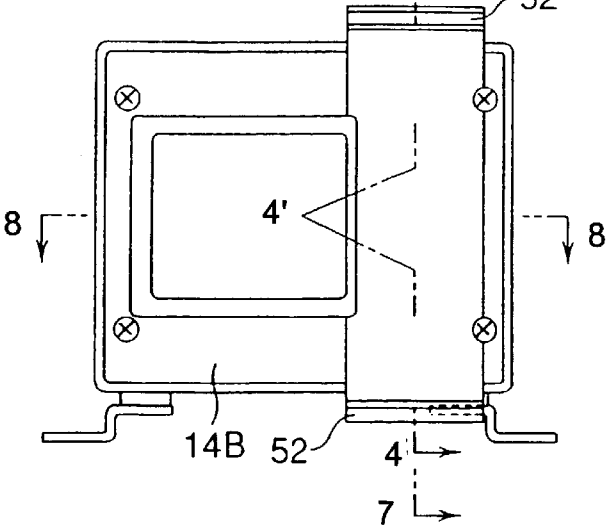
Figure 2C:
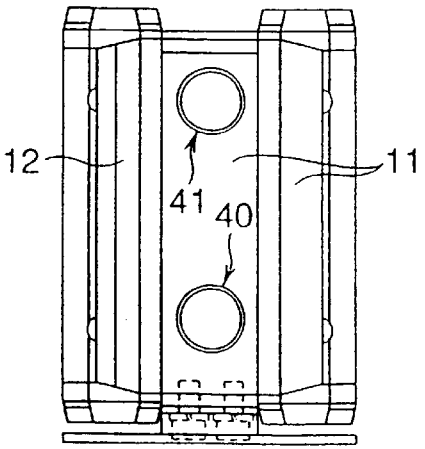
Figure 2A:
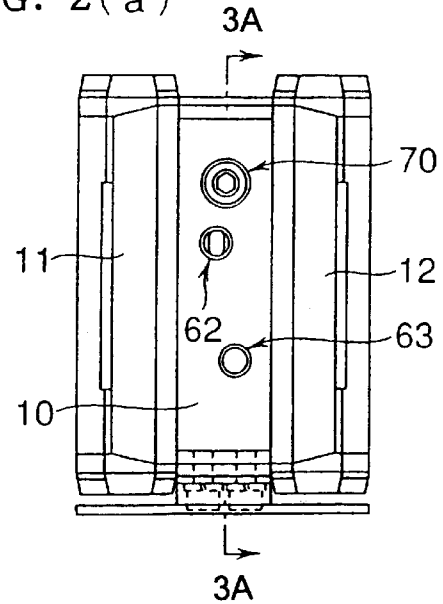

FIG. 1 shows the essential parts of the process pump with a first resin cover 14A and a second resin cover 14B removed therefrom. The essential parts are roughly divided into three groups, i.e. a center plate 10, a side body 11, and a side cover 12. As shown in FIGS. 2(*a*) to 7, the outer surfaces of the essential parts are covered with the first resin cover 14A and the second resin cover 14B. An air driving mechanism of the process pump is arranged as shown in the pneumatic circuit diagram of FIG. 9. The air driving mechanism is provided in the center plate 10.

Figure 4:
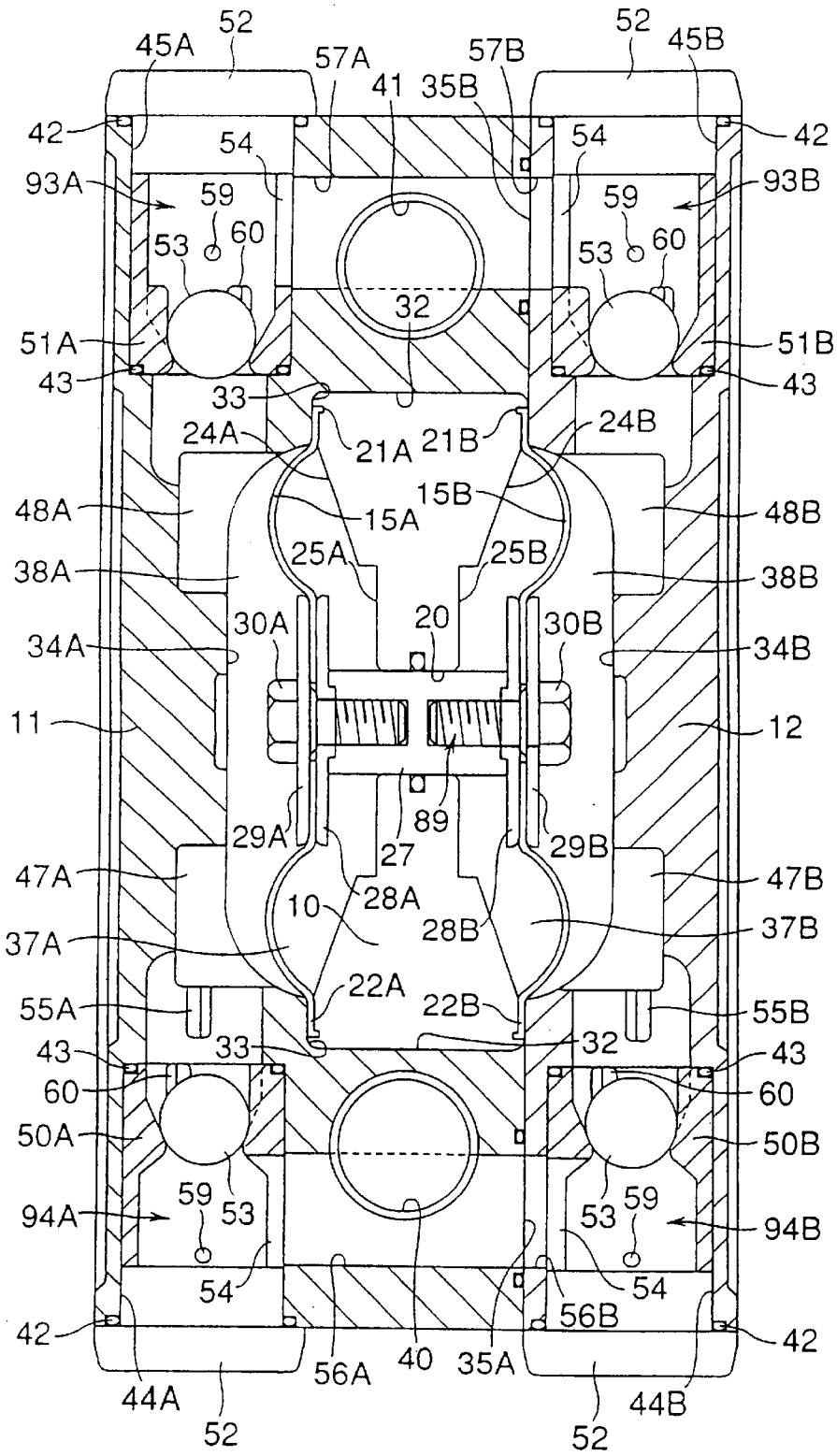
FIG. 4 is a sectional view taken along the line B-B'-B in FIG. 2(*b*).
Figures 5A, 5B:
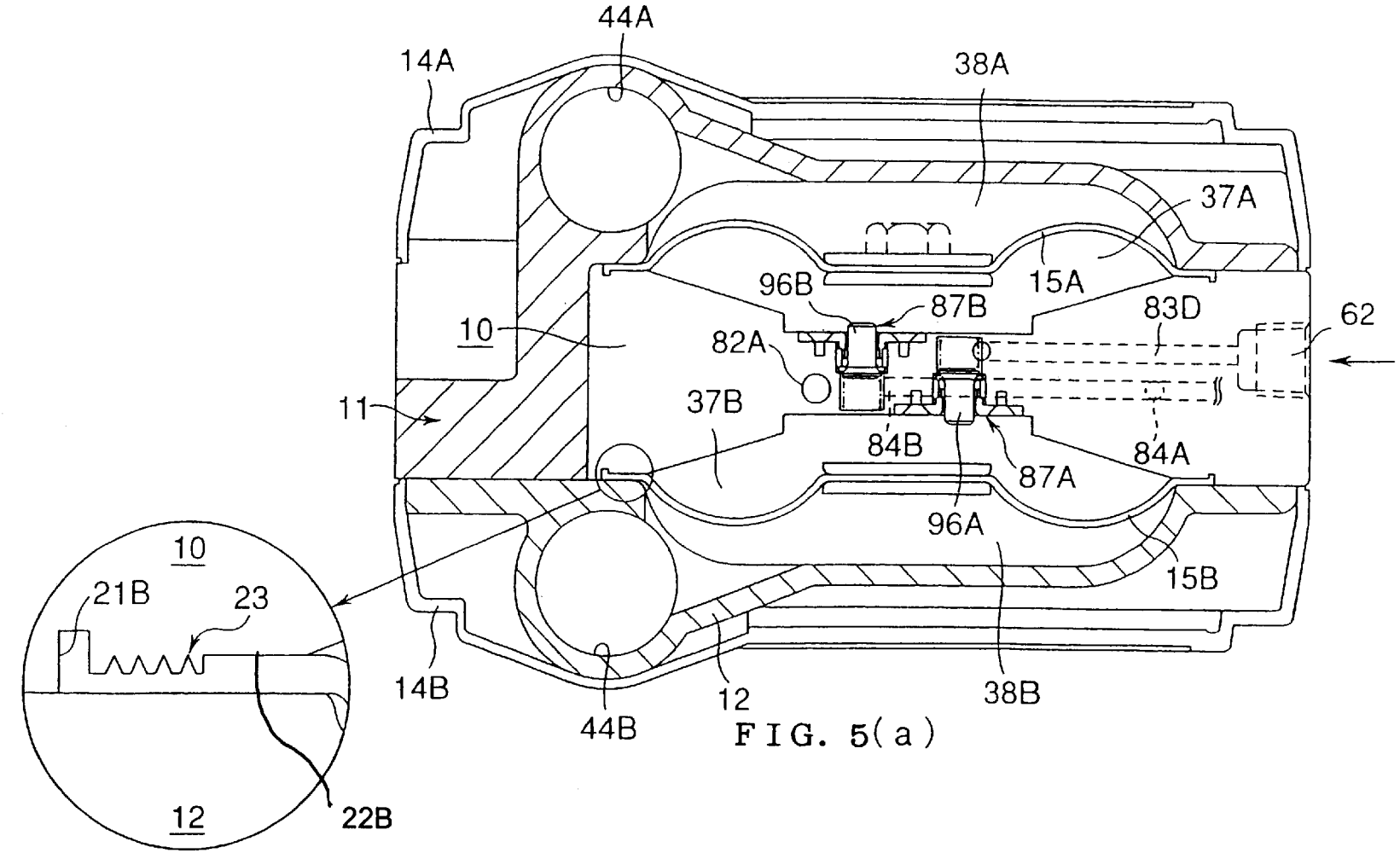
FIG. 5(*a*) is a sectional view taken along the line C—C in FIG. 3(*a*).
Figure 8:
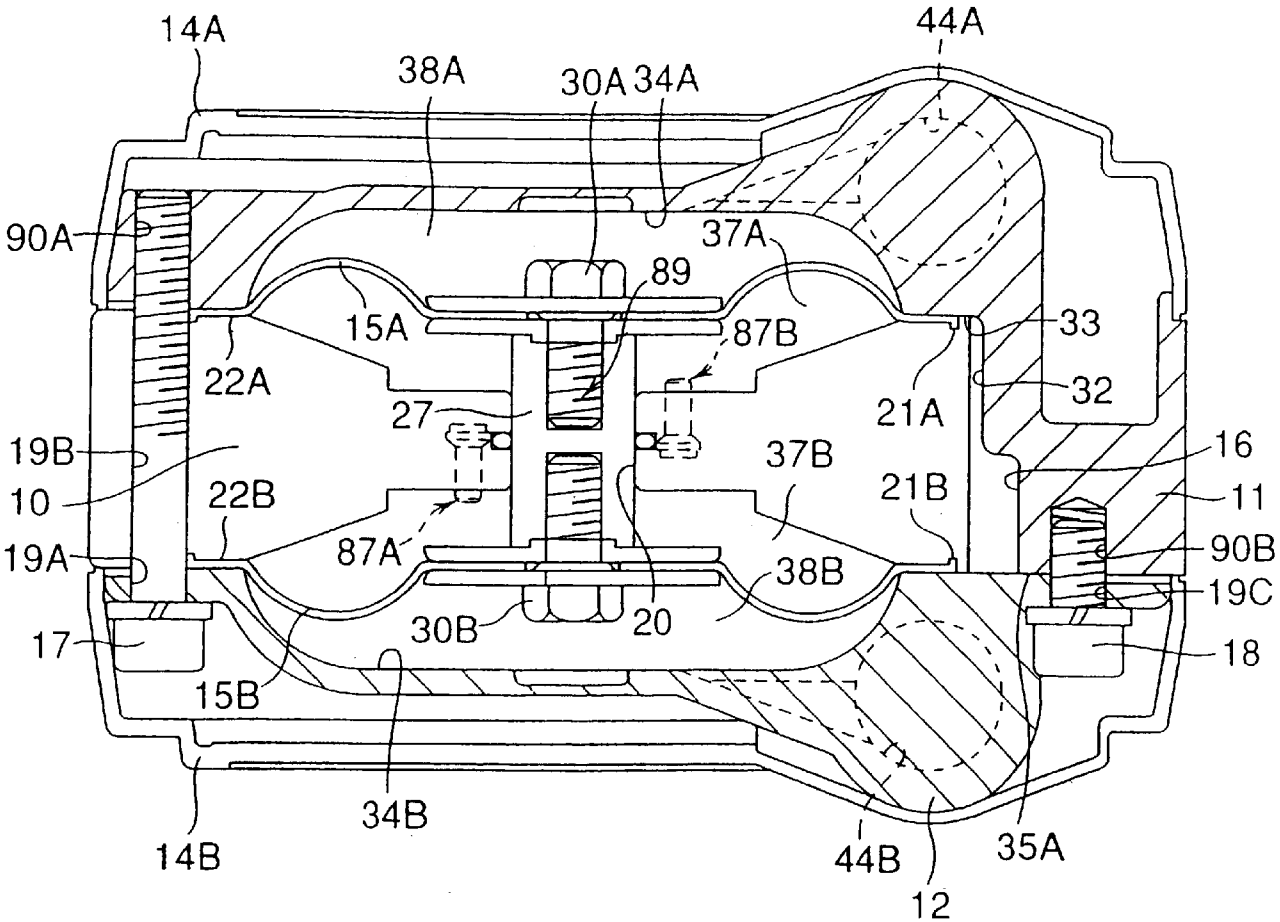
FIG. 8 is a sectional view taken along the line F—F in FIG. 2(*b*)
Figure 9:
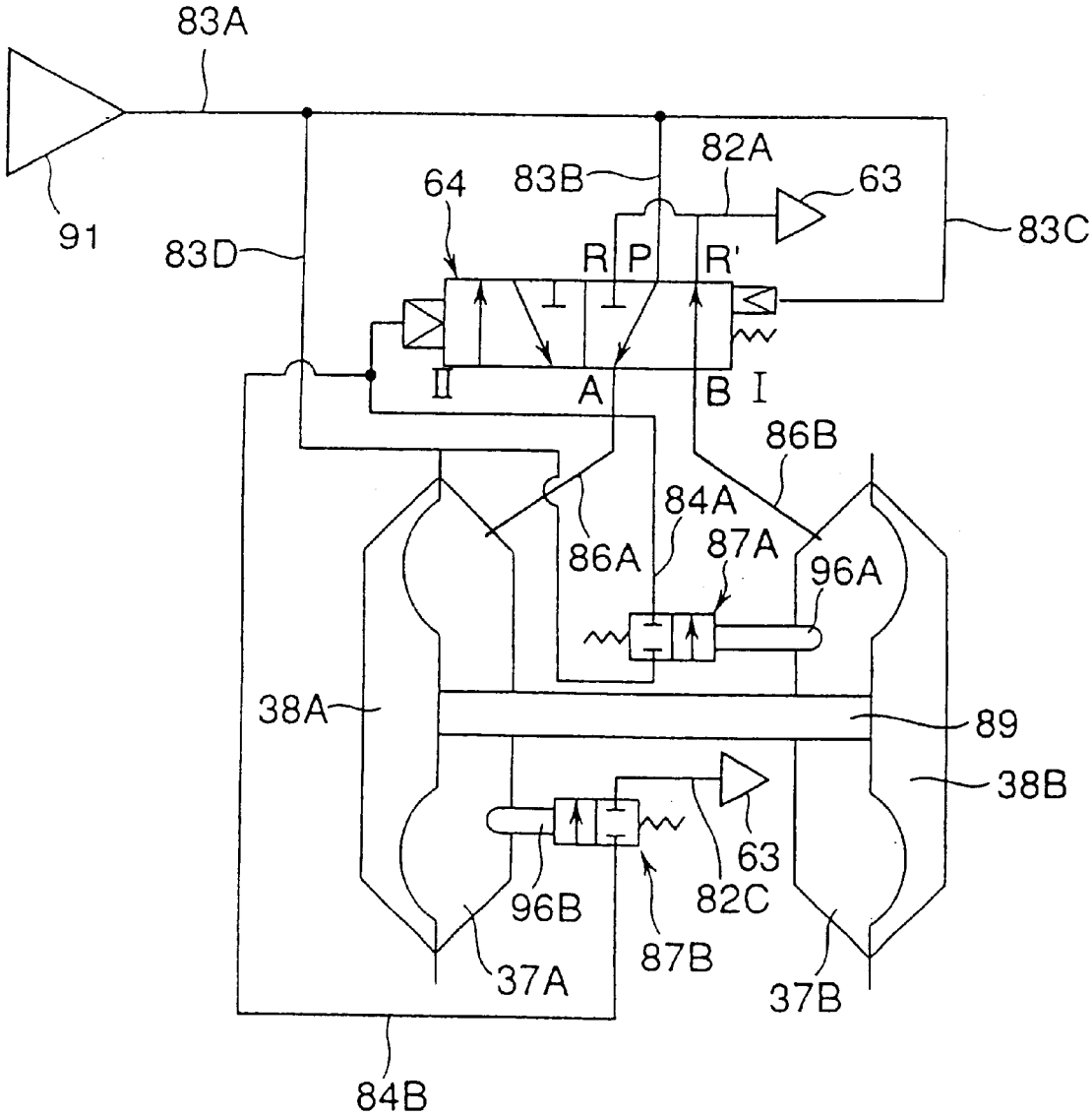
FIG. 9 is a pneumatic circuit diagram showing an air driving mechanism used in the double-acting process pump according to the embodiment of the present invention.

As shown in FIGS. 1, 4 and 8, the center plate 10 has a center hole 20 (insertion hole) provided in the center thereof. A first annular engagement groove 21A and a second annular engagement groove 21B are circumferentially formed in both sides, respectively, of the center plate 10 so as to be centered at the center hole 20. Annular first and second clamp portions 22A and 22B with a predetermined width are formed inside the first and second annular engagement grooves 21A and 21B, respectively. As shown in FIG. 5(*b*), V-shaped grooves 23 are formed on each of the first and second clamp portions 22A and 22B. The V-shaped grooves 23 enhance clamping force applied to a first diaphragm 15A and a second diaphragm 15B as clamped. Frusto-conical slant portions 24A and 24B, step portions and annular flat portions 25A and 25B are contiguously formed radially inside the first and second clamp portions 22A and 22B. The radially inner ends of the flat portions 25A and 25B are connected to the center hole 20.

The center plate 10 has an annular groove that opens to the center hole 20. An annular packing is fitted in the annular groove. A connecting shaft 27 is inserted into the center hole 20. The packing maintains hermetic sealing between the center hole 20 and the connecting shaft 27. The central portions (including O-rings inside the center holes) of the first and second diaphragms 15A and 15B are clamped by respective pairs of inner and outer diaphragm shells 28A and 29A, and 28B and 29B. The clamped assemblies are pierced with bolts 30A and 30B, respectively. The bolts 30A and 30B are screwed into respective threaded portions (non-through) at both ends of the connecting shaft 27. The connecting shaft 27 and the bolts 30A and 30B constitute a connecting member 89 that connects together the first diaphragm 15A and the second diaphragm 15B. The connecting shaft 27 has annular recesses formed in both ends thereof. The inner diaphragm shells 28A and 28B have annular projections formed in the respective central portions on the inner sides thereof. The annular projections of the inner diaphragm shells 28A and 28B are fitted into the respective annular recesses of the connecting shaft 27, thereby effecting positioning. The first and second diaphragms 15A and 15B have respective annular projections formed on the outer peripheries thereof. The annular projections are engaged with the first and second annular engagement grooves 21A and 21B, respectively of the center plate 10.

The inner side of the side body 11 is provided with a fitting recess 16 for fitting the center plate 10. The left-hand side of the fitting recess 16 (see FIGS. 1 and 8) is open. The fitting recess 16 comprises plane portions 32 contiguous with a first abutting portion 35A at the open end; a stepped clamp portion 33 formed from a vertical annular surface; and a dish-shaped first recess portion 34A. The side cover 12 has a second abutting portion 35B and a dish-shaped second recess portion 34B, which are provided on the inner side thereof. The inner peripheral annular portion of the second abutting portion 35B functions as a clamp portion for the second diaphragm 15B.

The center plate 10, which contains the controller and has the first and second diaphragms 15A and 15B attached thereto, is fitted into the fitting recess 16 of the side body 11. The second abutting portion 35B of the side cover 12 is brought into contact with the first abutting portion 35A of the side body 11 and the outer peripheral portion of the center plate 10 and also the outer peripheral portion of the outer side of the second diaphragm 15B. With the three groups, i.e. the side body 11, the center plate 10 and the side cover 12, connected together, hexagon socket head cap continuous-thread studs 17 are inserted into insertion holes 19A and 19B of the side cover 12 and the center plate 10 from the outside of the side cover 12, and the continuous-thread studs 17 are screwed into respective threaded holes 90A of the side body 11. Moreover, hexagon socket head cap short studs 18 are inserted into insertion holes 19C of the side cover 12 from the outside of the side cover 12. The short studs 18 are screwed into respective threaded holes 90B of the side body 11 (see FIG. 8). Thus, the side body 11, the center plate 10 and the side cover 12 are connected together. It should be noted that the center plate 10 is provided with positioning pin projections (not shown), and the side body 11 and the side cover 12 are provided with respective positioning pin recesses (not shown). After the projections have been engaged with the recesses to effect positioning, the side body 11, the center plate 10 and the side cover 12 are connected together as described above.

As a result of the connection of the side body 11, the center plate 10 and the side cover 12, the outer peripheral portion of the first diaphragm 15A is clamped between the stepped clamp portion 33 of the side body 11 and the first clamp portion 22A of the center plate 10, and the outer peripheral portion of the second diaphragm 15B is clamped between the inner peripheral portion of the second abutting portion 35B of the side cover 12 and the second clamp portion 22B of the center plate 10. A first driving chamber 37A is hermetically formed between one side of the center plate 10 and the first diaphragm 15A, and a second driving chamber 37B is hermetically formed between the other side of the center plate 10 and the second diaphragm 15B. A first pump chamber 38A is formed between the first recess portion 34A of the side body 11 and the first diaphragm 15A, and a second pump chamber 38B is formed between the second recess portion 34B of the side cover 12 and the second diaphragm 15B.

The side body 11 and the side cover 12 have thick-walled portions at the right ends thereof [as viewed in FIGS. 2(*b*) and 2(*d*)]. As shown in FIGS. 4, 5(*a*), 5(*b*) and 7, the thick-walled portion of the side body 11 is provided with a suction-side first stepped insertion hole 44A, the lower end of which is open and which extends vertically. Similarly, the thick-walled portion of the side cover 12 is provided with a suction-side second stepped insertion hole 44B, the lower end of which is open and which extends vertically. Further, the thick-walled portion of the side body 11 is provided with a discharge-side first stepped insertion hole 45A, the upper end of which is open and which extends vertically. Similarly, the thick-walled portion of the side cover 12 is provided with a discharge-side second stepped insertion hole 45B, the upper end of which is open and which extends vertically. The suction-side first stepped insertion hole 44A and the suction-side second stepped insertion hole 44B each have a relatively large diameter at the open (lower) end thereof and a relatively small diameter at the upper end thereof. The small-diameter portion of the suction-side first stepped insertion hole 44A is communicated with the first pump chamber 38A through a suction-side first passage 47A, and the small-diameter portion of the suction-side second stepped insertion hole 44B is communicated with the second pump chamber 38B through a suction-side second passage 47B. The discharge-side first stepped insertion hole 45A and the discharge-side second stepped insertion hole 45B each have a relatively large diameter at the open (upper) end thereof and a relatively small diameter at the lower end thereof. The small-diameter portion of the discharge-side first stepped insertion hole 45A is communicated with the first pump chamber 38A through a discharge-side first passage 48A. The small-diameter portion of the discharge-side second stepped insertion hole 45B is communicated with the second pump chamber 38B through a discharge-side second passage 48B.

Suction-side valve seat members 50A and 50B are inserted into the suction-side first stepped insertion hole 44A and the suction-side second stepped insertion hole 44B, respectively, from the lower sides thereof. Then, the insertion holes 44A and 44B are closed with check valve covers 52, respectively. Small-diameter valve seats are formed on the upper inner surfaces of the suction-side valve seat members 50A and 50B. Check valve elements 53 have previously been placed on the upper sides of the valve seats, respectively. Similarly, discharge-side valve seat members 51A and 51B are inserted into the discharge-side first stepped insertion hole 45A and the discharge-side second stepped insertion hole 45B, respectively, from the upper sides thereof. Then, the insertion holes 45A and 45B are closed with check valve covers 52, respectively. As shown in FIG. 1, bolts 30C are inserted into respective insertion holes provided in the flange portions of each check valve cover 52, and the bolts 30C are screwed into respective threaded holes 90C provided in the side body 11 or the side cover 12, thereby securing the check valve covers 52 to the side body 11 and the side cover 12, respectively.

Small-diameter valve seats are formed on the inner surfaces at the lower ends of the discharge-side valve seat members 51A and 51B, respectively. Check valve elements 53 have previously been placed on the upper sides of the valve seats, respectively. The suction-side valve seat members 50A and 50B and the check valve elements 53 constitute a suction-side first check valve 94A and a suction-side second check valve 94B, respectively. Similarly, the discharge-side valve seat members 51A and 51B and the check valve elements 53 constitute a discharge-side first check valve 93A and a discharge-side second check valve 93B, respectively. The areas between the inner ends of the valve seat members 50A, 50B, 51A and 51B on the one hand and the step portions of the insertion holes 44A, 44B, 45A and 45B on the other are hermetically sealed by O-rings 43, respectively. The areas between the open ends of the insertion holes 44A, 44B, 45A and 45B on the one hand and the large-diameter portions of the check valve covers 52 on the other are hermetically sealed by O-rings 42, respectively. It should be noted that stoppers 55A and 55B project downward into the small-diameter portions of the suction-side first and second stepped insertion holes 44A and 44B to prevent the check valve elements 53 from flowing into the first and second pump chambers 38A and 38B, respectively. Moreover, the valve seat members 50A, 50B, 51A and 51B are provided with guides 60 for guiding the check valve elements 53 to the respective valve seats.

As shown clearly in FIG. 2(*c*), the side body 11 has a suction opening 40 and a discharge opening 41, which open horizontally on the lower and upper portions, respectively, of the right side surface of the side body 11. As shown clearly in FIGS. 4, 6 and 7, the discharge opening 41 is communicated with the discharge-side first stepped insertion hole 45A through a discharge-side communicating passage 57A formed in the side body 11. The discharge-side communicating passage 57A is communicated with the discharge-side second stepped insertion hole 45B through a discharge-side communicating passage 57B formed in the side cover 12. Similarly, the suction opening 40 is communicated with the suction-side first stepped insertion hole 44A through a suction-side communicating passage 56A formed in the side body 11. The suction-side communicating passage 56A is communicated with the suction-side second stepped insertion hole 44B through a suction-side communicating passage 56B formed in the side cover 12. The joint between the discharge-side communicating passage 57A and the discharge-side communicating passage 57B is hermetically sealed by an O-ring. Similarly, the joint between the suction-side communicating passage 56A and the suction-side communicating passage 56B is hermetically sealed by an O-ring. Communicating grooves 54 are formed in the respective cylindrical portions of the suction-side valve seat members 50A and 50B and the discharge-side valve seat members 51A and 51B. The communicating grooves 54 of the discharge-side valve seat members 51A and 51B are aligned with the discharge-side communicating passages 57A and 57B to provide communication between the discharge opening 41 and the insides of the discharge-side valve seat members 51A and 51B. The communicating grooves 54 of the suction-side valve seat members 50A and 50B are aligned with the suction-side communicating passages 56A and 56B to provide communication between the suction opening 40 and the insides of the suction-side valve seat members 50A and 50B. These aligned conditions are maintained by inserting parallel pins 59 into insertion holes in the cylindrical portions of the valve seat members 50A, 50B, 51A and 51B and further into insertion holes (not shown) provided in the side body 11.

As shown clearly in FIGS. 2(*a*), 3(*a*) and 6, the center plate 10 is provided with an air supply opening 62 and an air exhaust opening 63, which face horizontally. The air supply opening 62 and the air exhaust opening 63 open on the left side surface [on the right side surface in FIGS. 3(*a*) and 6] of the center plate 10 at respective positions slightly away from the center toward the upper and lower ends, respectively. The upper portion of the center plate 10 is provided with a stepped insertion hole 65 for a switching valve. The insertion hole 65 longitudinally extends through the center plate 10. One open end of the insertion hole 65 is located in the fitting recess 16. The other end of the insertion hole 65 opens on the left side surface of the center plate 10.

A sleeve 67 is inserted into the small-diameter portion of the switching valve insertion hole 65. One end [the left end as viewed in FIG. 3(*a*); hereinafter referred to as "first end"] of the insertion hole 65 is closed by screwing an end cap 68 thereinto. The area between the outer periphery of the end cap 68 and the insertion hole 65 is hermetically sealed by an O-ring. One end of the sleeve 67 abuts on the end cap 68, and the other end [the right end in FIG. 3(*a*)] of the sleeve 67 abuts on an annular stopper 69. A hollow manual cap 70 is inserted into and thread-engaged with the large-diameter portion of the switching valve insertion hole 65. The stopper 69 is pressed and thus positioned by the manual cap 70. The manual cap 70 has a stepped hole 72 extending therethrough. The stepped hole 72 comprises a small-diameter hole, an intermediate-diameter hole and a large-diameter hole, which are formed in series from the outer end. A manual pin 73 with a head is inserted into the small-diameter hole from the intermediate-diameter hole. The head of the manual pin 73 lies in the intermediate-diameter hole, and the body of the manual pin 73 is thread-engaged with the small-diameter hole. The area between the body of the manual pin 73 and the small-diameter hole is hermetically sealed by an O-ring. When the manual pin 73 is pushed with a tool inserted from the open end of the stepped hole 72 and engaged with the manual pin 73, the manual pin 73 moves rectilinearly. The manual cap 70 has an annular groove 74B formed in an approximately central portion of the outer periphery thereof. The annular groove 74B and the intermediate-diameter hole of the stepped hole 72 are communicated with each other through a passage. Annular grooves are formed on the outer periphery of the manual cap 70 at respective positions in front of and behind the annular groove 74B. O-rings fitted in the annular grooves hermetically seal the area between the manual cap 70 and the switching valve insertion hole 65.

A spool 66 is slidably fitted in the sleeve 67. Between one end (hereinafter referred to as "first end") of the spool 66 and the end cap 68, a return spring 75 is loaded, and a first pilot chamber 76A is formed. The air pressure in the first pilot chamber 76A is acting on the first end of the spool 66. A piston 78 is slidably fitted in the large-diameter hole of the stepped hole 72 in the manual cap 70. The area between the outer periphery of the piston 78 and the large-diameter hole of the stepped hole 72 is hermetically sealed by a seal fitted in an annular groove on the outer periphery of the piston 78. One end (hereinafter referred to as "first end") of the piston 78 is engaged with the other end (hereinafter referred to as "second end") of the spool 66. A second pilot chamber 76B is formed in the large-diameter hole of the stepped hole 72 at the other end (hereinafter referred to as "second end") of the piston 78, thereby enabling a pilot pressure to act on the second end of the piston 78 (described later).

The pilot pressure-receiving area of the piston 78 is twice as large as the pressure-receiving area of the first end of the spool 66. It has been set so that the force acting on the first end of the spool 66 (i.e. the pilot pressure×the pressure-receiving area+the resilient force of the return spring 75) is smaller than the force acting on the second end of the piston 78 (i.e. the pilot pressure×the pressure-receiving area). An exhaust chamber 79 is formed in the center plate 10 above the sleeve 67. The chamber at the first end of the piston 78 is communicated with the exhaust chamber 79 through an exhaust passage 82B. The upper end of the exhaust chamber 79 is closed by an exhaust cover 80.

Figure 6:
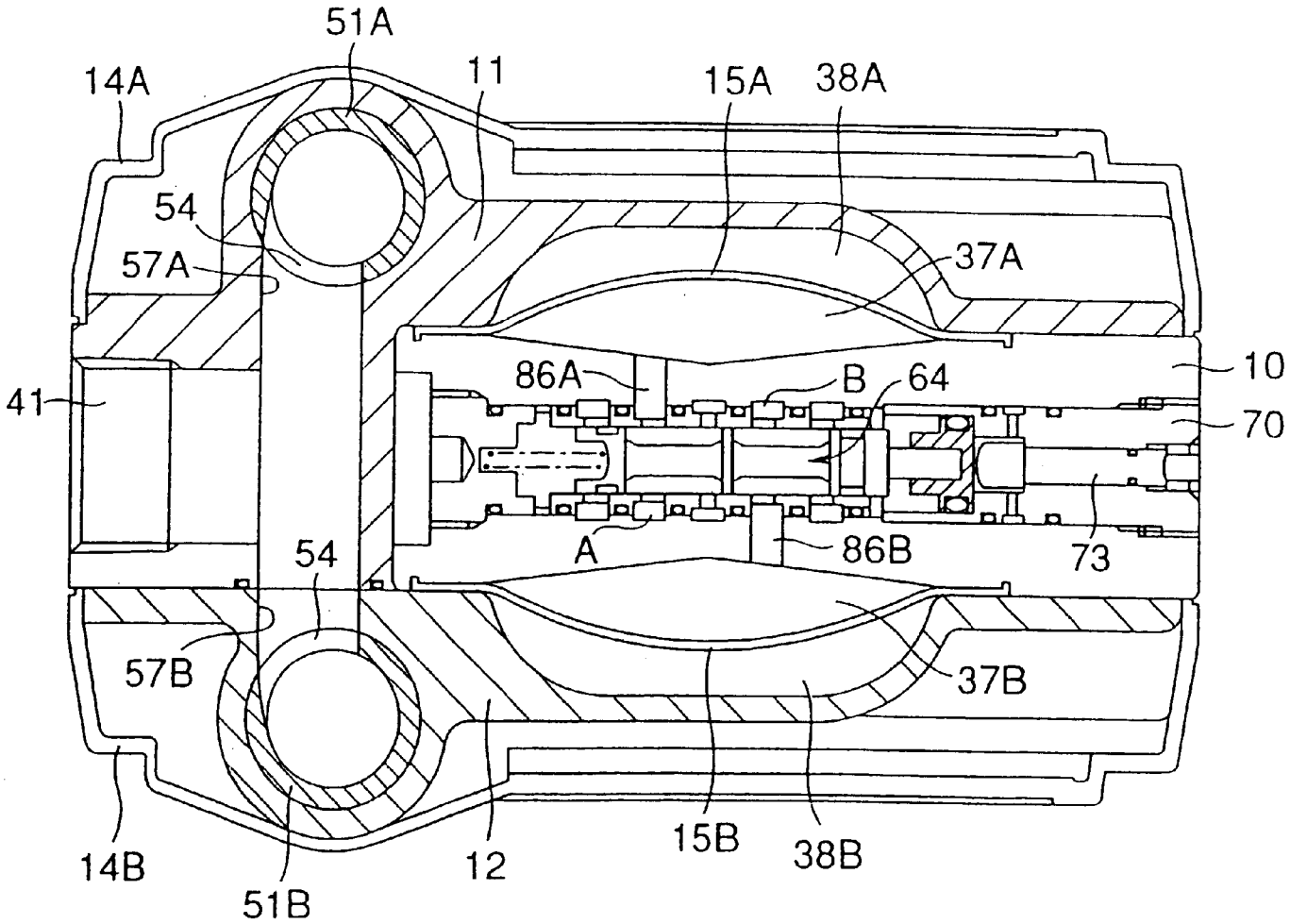
FIG. 6 is a sectional view taken along the line D—D in FIG. 3(*a*).
Figure 7:
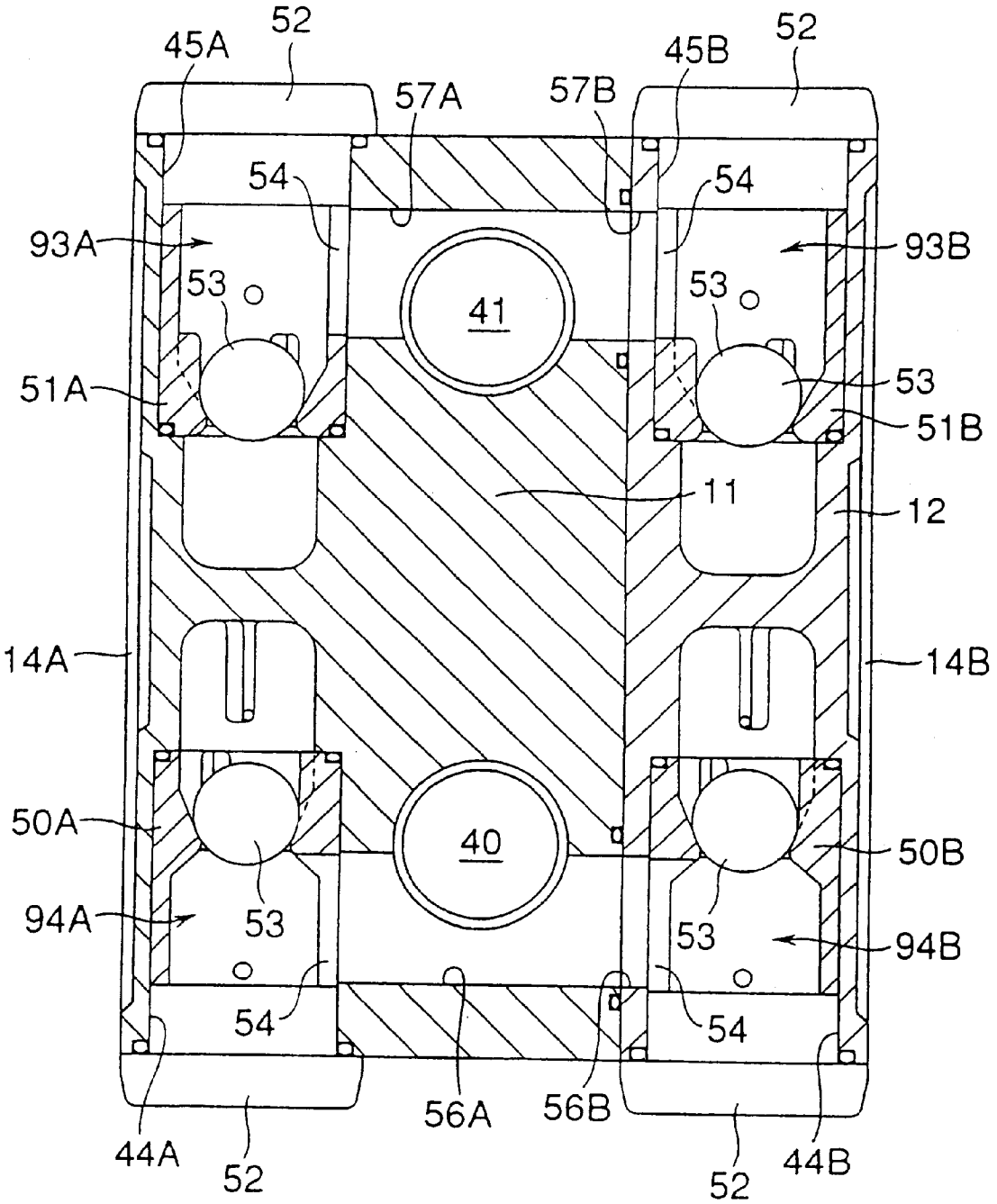
FIG. 7 is a sectional view taken along the line E—E in FIG. 2(*b*).

Between the switching valve insertion hole 65 and the sleeve 67, an annular groove 74A, an R-port, an A-port, a P-port, a B-port and an R'-port are formed successively from the first end side of the insertion hole 65. The R-port and the R'-port are communicated with each other through the exhaust chamber 79. Thus, a two-position and five-port switching valve 64 is constructed. The P-port is communicated with the air supply opening 62 through supply passages 83B and 83A. The R-port is communicated with the air exhaust opening 63 through an exhaust passage 82A. As shown in FIG. 6, the A-port is communicated with the first driving chamber 37A through a first air communicating passage 86A, and the B-port is communicated with the second driving chamber 37B through a second air communicating passage 86B. The first pilot chamber 76A is communicated with the air supply opening 62 through the annular groove 74A and supply passages 83C and 83A. The second pilot chamber 76B is communicated with an outlet of a first pilot valve 87A through the annular groove 74B and a pilot passage 84A and also communicated with an inlet of a second pilot valve 87B through the pilot passage 84A and a pilot passage 84B. An inlet of the first pilot valve 87A is communicated with the air supply opening 62 through a supply passage 83D and the supply passage 83A. An outlet of the second pilot valve 87B is communicated with the air exhaust opening 63 through an exhaust passage 82C and the exhaust passage 82A (see also FIG. 9).

Figure 3B:
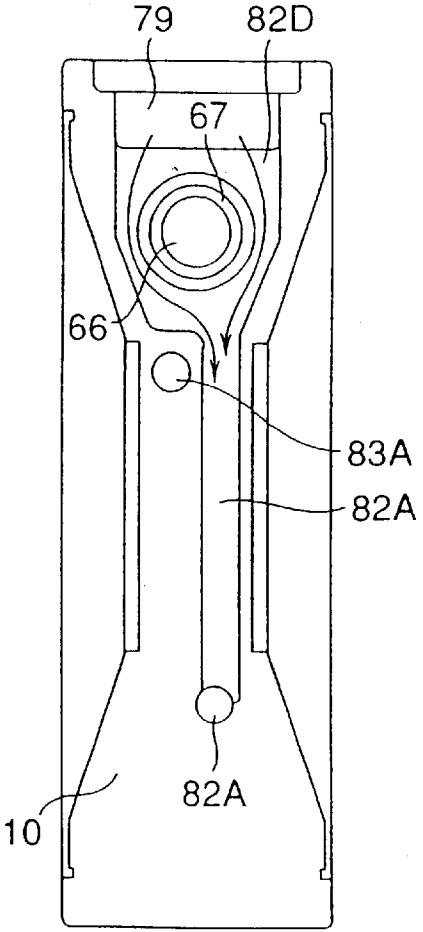
FIG. 3(*a*) is a sectional view taken along the line A—A in FIG. 2(*a*).
Figure 3A:
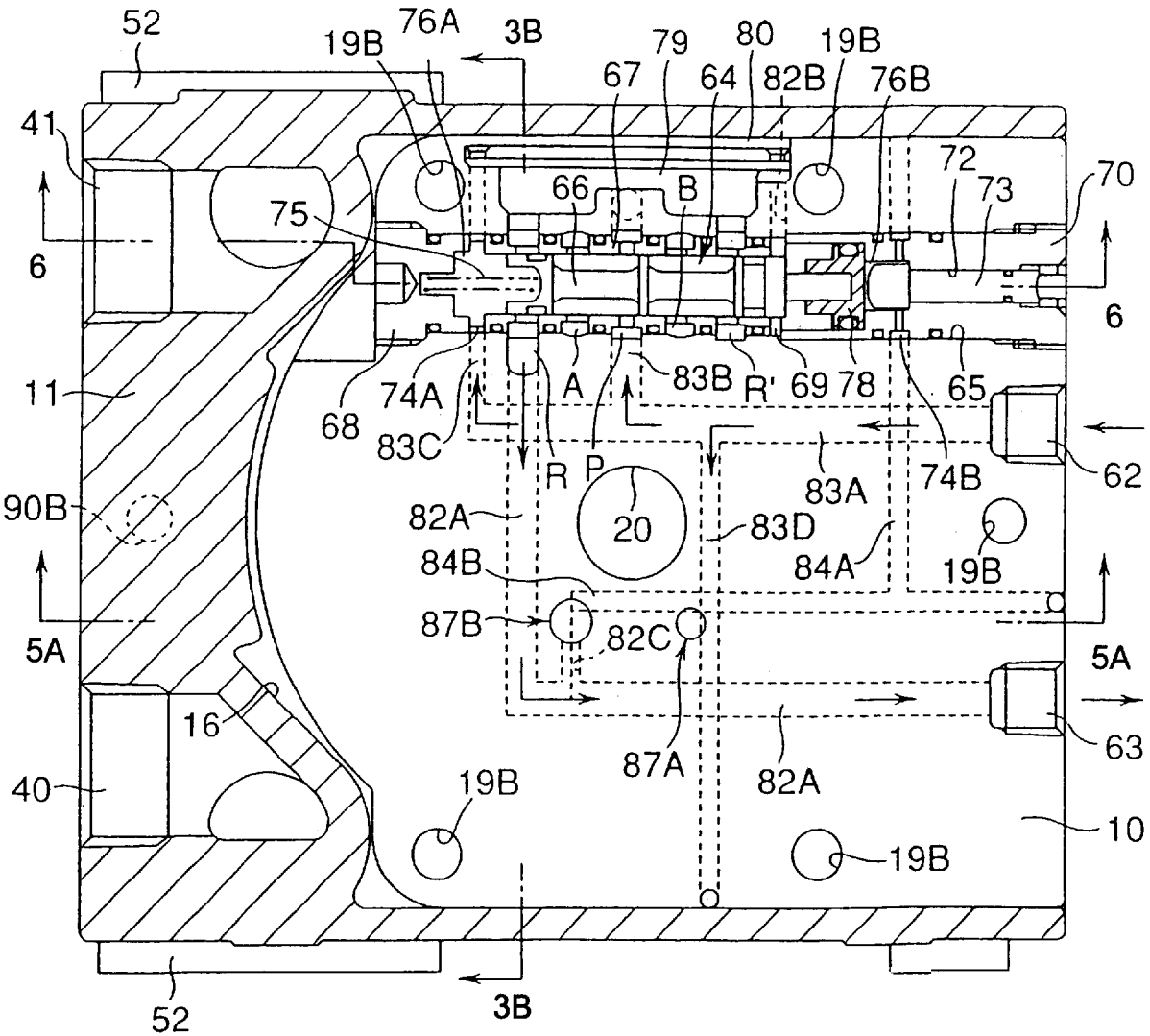

If dust is caught in the area between the spool 66 and the sleeve 67 of the switching valve 64, the manual pin 73 is pushed, and in cooperation with the return spring 75, the manual pin 73 and the spool 66 are moved back and forth. In most cases, the dust is destroyed and removed by this operation. If the dust cannot sufficiently be destroyed by the above operation, the manual cap 70, the piston 78, the stopper 69, the spool 66 and the sleeve 67 are removed. Then, the dust is removed, and the system is set up. It should be noted that, in FIG. 3(*a*), the ends of bored holes contiguous with the supply passages 83C and 83D and the pilot passages 84A and 84B are blocked by blocking members. As shown in FIGS. 3(*a*) and 3(*b*), an exhaust passage 82D as cast is provided around the sleeve 67 in a vertical section containing the R-port of the switching valve 64. The exhaust passage 82D provides communication between the exhaust chamber 79 and the exhaust passage 82A. It should be noted that each member of the process pump according to the embodiment of the present invention uses the most suitable material selected in conformity to a fluid to be transferred, and that there is no particular restriction on the material used.

The function of the embodiment of the double-acting process pump according to the present invention will be described below.

For example, the suction opening 40 is communicated with a storage tank for a fluid to be transferred by piping, and the discharge opening 41 is communicated with a transfer destination by piping. The air supply opening 62 is communication with an air pressure source 91, and the air exhaust opening 63 is open to the atmosphere. Then, compressed air is supplied to the air supply opening 62. At this time, the spool 66 of the switching valve 64 is held in the initial position shown in FIGS. 3(*a*) and 6 (position I in FIG. 9) by the pressure from the return spring 75. The compressed air is supplied to the first driving chamber 37A through the supply passages 83A and 83B, the P-port and A-port of the switching valve 64 and the first air communicating passage 86A, and the air in the second driving chamber 37B is released into the atmosphere through the second air communicating passage 86B, the B-port and R'-port of the switching valve 64, the exhaust chamber 79 and the exhaust passage 82D and also through the R-port of the switching valve 64 and the exhaust passage 82A. Because the first diaphragm 15A and the second diaphragm 15B are connected together by the connecting member 89, the first driving chamber 37A is expanded by the air pressure, and the second driving chamber 37B contracts. Consequently, the first pump chamber 38A contracts, and the second pump chamber 38B expands. Accordingly, as shown in FIG. 4, the transfer fluid in the first pump chamber 38A is discharged through the discharge-side first passage 48A, the discharge-side first check valve 93A, the discharge-side communicating passage 57A and the discharge opening 41. The transfer fluid in the storage tank is sucked into the second pump chamber 38B through the suction opening 40, the suction-side communicating passages 56A and 56B, the suction-side second check valve 94B and the suction-side second communicating passage 47B.

When the second driving chamber 37B has sufficiently contracted, a push rod 96A of the first pilot valve 87A is pressed by the inner diaphragm shell 28B, causing the first pilot valve 87A to be switched. Consequently, the inlet and outlet of the first pilot valve 87A are communicated with each other. The air from the air supply opening 62 flows into the second pilot chamber 76B through the supply passages 83A and 83D, the inlet and outlet of the first pilot valve 87A, the pilot passage 84A and the annular groove 74B. Because the force acting on the second end of the spool 66 (i.e. the pressure-receiving area of the piston 78×the pilot pressure) is larger than the force acting on the first end of the spool 66 (i.e. resultant force from the resilient force of the return spring 75 and the pilot pressure), the switching valve 64 is switched to position II [in FIG. 3(*a*), the spool 66 moves leftward].

The air is supplied to the second driving chamber 37B through the supply passages 83A and 83B, the P-port and B-port of the switching valve 64 and the second air communicating passage 86B, and the air in the first driving chamber 37A is released into the atmosphere through the first air communicating passage 86A, the A-port and R-port of the switching valve 64 and the exhaust passage 82A. The second driving chamber 37B is expanded by the air pressure, and the first driving chamber 37A contracts. Consequently, the first pump chamber 38A expands, and the second pump chamber 38B contracts. Accordingly, as shown in FIG. 4, the transfer fluid in the second pump chamber 38B is discharged through the discharge-side second passage 48B, the discharge-side second check valve 93B, the discharge-side communicating passage 57B and the discharge opening 41. The transfer fluid in the storage tank is sucked into the first pump chamber 38A through the suction opening 40, the suction-side communicating passage 56A, the suction-side first check valve 94A and the suction-side first communicating passage 47A. When the second driving chamber 37B has expanded to a predetermined extent, the inner diaphragm shell 28B separates from the push rod 96A of the first pilot valve 87A. Thus, the first pilot valve 87A is switched to the initial position. The inlet and outlet of the first pilot valve 87A are cut off from each other, and the air supply to the second pilot chamber 76B is cut off. However, the position of the spool 66 is maintained by the air accumulated in the second pilot chamber 76B.

When the first driving chamber 37A has sufficiently contracted, a push rod 96B of the second pilot valve 87B is pressed by the inner diaphragm shell 28A, causing the second pilot valve 87B to be switched. Consequently, the inlet and outlet of the second pilot valve 87B are communicated with each other. The air in the second pilot chamber 76B is released into the atmosphere through the annular groove 74B, the pilot passages 84A and 84B, the inlet and outlet of the second pilot valve 87B, the exhaust passages 82C and 82A and the air exhaust opening 63. The switching valve 64 is switched to position I [in FIG. 3(*a*), the spool 66 moves rightward], thus returning to the initial position shown in FIGS. 3(*a*) and 6.

Thus, the supply and exhaust of air are alternately carried out with respect to the first driving chamber 37A and the second driving chamber 37B, and the suction and discharge of the transfer fluid are alternately carried out in the first pump chamber 38A and the second pump chamber 38B.

In the process pump according to the first aspect of the present invention, the center plate is clamped between the side body and the side cover, and these three members are connected together to assemble the process pump. Unlike the prior art, the process pump according to the present invention has no need of assembling a suction-side plate and a discharge-side plate. Accordingly, the number of members to be assembled is smaller than in the prior art. Moreover, in the process pump according to the present invention, neither a suction-side plate nor a discharge-side plate extends across the center plate and two pump bodies as in the prior art. Therefore, the process pump is advantageous in terms of leakage.

In the process pump according to the second aspect of the present invention, two diaphragms are clamped between the center plate on the one hand and the side body and the side cover on the other. The diaphragms, which are expendable supplies, can be readily replaced or inspected by detaching the side body and the side cover from the center plate. Because the process pump according to the present invention does not use a suction-side plate and a discharge-side plate as in the prior art, the time and labor needed for the replacement or inspection reduce correspondingly.

In the process pump according to the third aspect of the present invention, when a check valve needs to be replaced or inspected, the necessary check valve members (the valve seat member and the check valve element) can be taken out by detaching the check valve cover for the check valve concerned.

In the process pump according to a further aspect of the present invention, constituent members, i.e. check valves, a suction opening, a discharge opening, an air supply opening, an air exhaust opening, and a switching valve, are rationally arranged, so that the volumetric capacity and height of the process pump can be reduced, and yet the discharge capacity can be increased despite the compact structure.

What is claimed is:

1. In a process pump of the type wherein a space defined by a center plate, together with a side cover and a side body, which are provided on both sides, respectively, of said center plate, is divided by two diaphragms into left and right driving chambers inside said diaphragms and left and right pump chambers outside said diaphragms, said two diaphragms being connected together by a connecting member extending through an insertion hole in said center plate, and wherein said left and right driving chambers are alternately supplied with and exhausted of air under control of a controller, and said left and right pump chambers are communicated with a suction opening through check valves and also communicated with a discharge opening through check valves, the improvement wherein said center plate is fitted in a recess formed in said side body, and said side cover is brought into contact with both said side body and said center plate to clamp said center plate by said side cover and said side body, and wherein passages for communication between said suction opening and said left and right pump chambers and passages for communication between said discharge opening and said left and right pump chambers are provided in said side body and said side cover, and said controller is provided in said center plate.

2. A process pump according to claim 1, wherein an outer peripheral portion of one of said two diaphragms is clamped between a stepped clamp portion of said recess in said side body and one of two clamp portions of said center plate, and an outer peripheral portion of the other diaphragm is clamped between an abutting portion of said side cover and the other clamp portion of said center plate.

3. A process pump according to claim 1 or 2, wherein said side body and said side cover have stepped insertion holes opening on upper and lower surfaces thereof, said check valves being inserted into said stepped insertion holes, respectively, each stepped insertion hole being closed with a check valve cover, and wherein said suction opening is communicated with said pump chambers through a pair of said check valves, and said discharge opening is communicated with said pump chambers through the other pair of said check valves.

4. A process pump according to claim 3, wherein said suction opening and said discharge opening open on a right side surface of said side body, said check valves being provided in right end portions of said side body and said side cover, and wherein said suction opening is communicated with inlet sides of a pair of said check valves, and said discharge opening is communicated with outlet sides of the other pair of said check valves.

5. A process pump according to claim 4, wherein said check valves each comprise an approximately cylindrical valve seat member and a check valve element, each suction-side valve seat member having a communicating groove formed in a side portion thereof below a valve seat formed by said valve seat member, each discharge-side valve seat member having a communicating groove formed in a side portion thereof above a valve seat formed by said valve seat member, and wherein each suction-side communicating groove is communicated with said suction opening through a suction-side communicating passage, and each discharge-side communicating groove is communicated with said discharge opening through a discharge-side communicating passage.

6. A process pump according to claim 1 or 2, wherein a switching valve of said controller is provided in said center plater said switching valve being arranged such that resilient force from a spring and an air pressure constantly act on one end of a spool of said switching valve, and a pilot air pressure acts on the other end of said spool.

7. A process pump according to claim 6, wherein an air supply opening and an air exhaust opening are provided to open on a left side surface of said center plate, said switching valve being inserted into a switching valve insertion hole having an opening on the left side surface of said center plate, said the other end of said spool being disposed closer to said opening of said switching valve insertion hole, said opening of said switching valve insertion hole being hermetically closed with a manual cap, and wherein a manual pin for controlling said spool is provided in said manual cap.

* * * * *